US006182968B1

(12) United States Patent
Wilkinson

(10) Patent No.: US 6,182,968 B1
(45) **Date of Patent: *Feb. 6, 2001**

(54) CARD GAMES AND METHODS OF PLAYING SAME

(76) Inventor: Lamar Wilkinson, 5867 Pacheco Blvd., Pacheco, CA (US) 94553

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/090,777

(22) Filed: Jun. 4, 1998

Related U.S. Application Data

(63) Continuation-in-part of application No. 08/646,097, filed on May 7, 1996, now abandoned, which is a continuation-in-part of application No. 08/519,461, filed on Aug. 25, 1995, now abandoned.

(51) Int. Cl.[7] ..... A63F 1/00
(52) U.S. Cl. ..... 273/292
(58) Field of Search ..... 273/292, 309, 273/274; 463/12

(56) References Cited

U.S. PATENT DOCUMENTS

| | | | | |
|---|---|---|---|---|
| 4,659,087 | | 4/1987 | Shen et al. | 273/274 |
| 5,072,946 | * | 12/1991 | Miller | 273/292 |
| 5,275,415 | * | 1/1994 | Wisted | 273/274 |
| 5,411,268 | | 5/1995 | Nelson et al. | 273/292 |
| 5,503,401 | | 4/1996 | Nguyen | 273/306 |
| 5,538,252 | * | 7/1996 | Green | 273/306 |
| 5,803,460 | * | 8/1998 | Hesse | 273/292 |

OTHER PUBLICATIONS

"Blackjack Casino Style", Scarnes's Encyclopedia Of Games, John Scarne, Harper & Row Publishers, pp. 276–285, 1973.*

"Super Blackjack", Casino Gaming Concepts, Inc., 1993.*

"21st Century Blackjack", Casino Gaming Concepts, Inc., 1994.*

"Blackjack, Casino Style Scarne's Encyclopedia of Games," John Scarne, Harper & Row Publishers, pp. 279–285.

"21st Century Blackjack," Casino Gaming Concepts, Inc., Copyright 1994.

"Super Blackjack," Casino Gaming Concepts, Inc., Copyright 1993.

"California Games," Casino Gaming Concepts, Inc., Copyright 1995.

Fax Transmittal from Card Player Magazine, Aug. 8, 1995 (2 pages).

Letter from Captain Ronald c. Black of the Los Angeles County Sheriff's Office, Mar. 29, 1995 (4 pages).

"Newjack," Game Description, Helix Information Services, Inc., Jul. 8, 1995 (15 pages).

"Newjack 22," Rules, Helix Information Services, Inc., May 18, 1995 (6 pages).

(List continued on next page.)

*Primary Examiner*—Benjamin H. Layno
(74) *Attorney, Agent, or Firm*—Townsend and Towensend and Crew LLP

(57) ABSTRACT

A card game of the modified pseudo-blackjack type in which the point value of each Joker is 2 or 12, the point value of each Ace is 1 or 11, a natural is any pair of cards the total point value of which is 22, and a pair of Aces outranks any other hand. A hand ranking chart of this game is shown in FIG. 2, and another hand ranking chart of this game is shown in FIG. 3. In certain versions of the game one player is designated the player-banker, and the option of serving as player-banker rotates among the players. A house-appointed dealer deals the cards but does not play or function as the banker. Another player is randomly selected at the beginning of each round to serve as the action player, who gets cards first, acts first on his or her hand, and has his or her bet or bets settled first.

21 Claims, 2 Drawing Sheets

HAND RANKINGS:

| HIGHEST | | | | | | | | | | | | LOWEST |
|---|---|---|---|---|---|---|---|---|---|---|---|---|
| FIRST | AA (NATURAL) | | | | | | | | | | | |
| THEN | TWO CARD 22 (NATURAL) | | | | | | | | | | | |
| NEXT | 22 | 21 | 20 | 19 | 18 | 17 | 16 | 15 | 14 | 13 | 12 | |
| LAST | 23 | 24 | 25 | 26 | 27 | 28 | 29 | 30 | 31 | | | |

OTHER PUBLICATIONS

Letter from Robert A Rizzo of the City of Bell, CA, dated Jun. 8, 1995 (2 pages).

Letter from Michael Hesse of Helix Information Services, Inc., Jul. 1, 1995 (2 pages).

* cited by examiner

HAND RANKINGS:

| | | | | | | | | | | | |
|---|---|---|---|---|---|---|---|---|---|---|---|
| HIGHEST | | | | | | | | LOWEST | | | |
| FIRST | AA | (NATURAL) | | | | | | | | | |
| THEN | TWO CARD 22 | | (NATURAL) | | | | | | | | |
| NEXT | 22 | 21 | 20 | 19 | 18 | 17 | 16 | 15 | 14 | 13 | 12 |
| LAST | 23 | 24 | 25 | 26 | 27 | 28 | 29 | 30 | 31 | | |

RANK DETERMINATION FUNCTION
EMBODIMENT II(1)

| (r) | (v) | (m) |
|---|---|---|
| 1 | TWO ACES (22) | A |
| 2 | JOKER + TEN OR FACE CARD (22) | A |
| 3 | 22 | A |
| 4 | 21 | A |
| 5 | 20 | A |
| 6 | 19 | A |
| 7 | 18 | A |
| 8 | 17 | P |
| 9 | 16 | P |
| 10 | 15 | P |
| 11 | 14 | P |
| 12 | 13 | P |
| 13 | 23 | A |
| 14 | 24 | A |
| 15 | 25 | A |
| 16 | 26 | A |
| 17 | 27 | A |
| 18 | 17 | B |
| 19 | 16 | B |
| 20 | 15 | B |
| 21 | 14 | B |
| 22 | 13 | B |
| 23 | 12 | A |
| 24 | 11 | A |
| 25 | 10 | A |
| 26 | 9 | A |
| 27 | 8 | A |
| 28 | 7 | A |
| 29 | 6 | A |
| 30 | 5 | A |
| 31 | 4 | A |

FIG. 3

1(AA:22)A; 2 (J+TF:22)A; 3(22)A; 4(21)A; 5(20)A; 6(19)A; 7(18)A; 8(17)P; 9(16)P; 10(15)P; 11(14)P; 12(13)P; 13(23)A; 14(24)A; 15(25)A; 16(26)A; 17(27)A; 18(17)B; 19(16)B; 20(15)B; 21(14)B; 22(13)B; 23(12)A; 24(11)A; 25(10)A; 26(9)A; 27(8)A; 28(7)A; 29(6)A; 30(5)A; 31(4)A

FIG. 4

CARD GAMES AND METHODS OF PLAYING SAME

This application is a continuation-in-part of U.S. patent application Ser. No. 08/646,097, filed May 7, 1996, by the same applicant and bearing the same title, now abandoned which in turn is a continuation-in-part of U.S. patent application Ser. No. 08/519,461, filed Aug. 25, 1995, by the same applicant, and bearing the same title now abandoned.

BACKGROUND OF THE INVENTION

1. Field of the Invention

The present invention relates to pseudo-blackjack games, as the term pseudo-blackjack is defined in the Glossary which is a part of this specification.

2. Description of the Prior Art

Pseudo-blackjack games are well known to those having ordinary skill in the card game art.

As is also well known to those having ordinary skill in the art, certain prior art casino and card room card games are relatively complicated, and require knowledge and ability which is beyond the scope of an unskilled card player, especially with respect to the determination of hand values.

Among the known pseudo-blackjack games is the card game of U.S. Pat. No. 5,275,415, which was issued to Roger L. Wisted on Jan. 4, 1994 (hereinafter called "Wisted"). The game of the Wisted patent is sometimes commercially called "Wisted Aces" or "Wisted's California Blackjack". The card game of Wisted is played with a fifty-six card deck and played to a predetermined unique point total on a table having a playing surface and several player stations surrounding said table and a card dealer station located between two of the players, and said dealer does not play hands, in which each station where a player is located initially receives two cards face down with the player adding the value of said cards and each player in rotation to receive one or more cards face up or to stand on the original cards in an endeavor to reach the point total or optimum point count, each player playing against the others of said players, and a winning player having the point total or a total less than or greater than said point total.

The hand ranking method of Wisted, in which the possible hands, in order, rank in value alternately above and below 22, has been found by some players to be unduly cumbersome, complex, and unfamiliar.

Further, the combination of two aces, which is defined by Wisted as a natural, i.e., a combination which immediately takes the hand being played, occurs infrequently, and thus limits the complexity, challenge and excitement of the game of Wisted. The same objection would be true of a game in which the only natural was a pair of Jokers.

Yet further, Wisted excludes the practice of "doubling down", i.e., increasing the player's wager after receiving his or her first two cards in certain stated circumstances, from the play of his game, and thus limits the complexity, challenge and excitement of his game.

Also, Wisted does not specifically recommend the treatment of ties to be varied in order to adjust the advantage to the players or the player-banker.

Yet again, the point valuation of jokers as one or eleven, found in the game of Wisted, limits the number of naturals occurring, and thus limits the complexity, challenge and excitement of the game of Wisted.

Other card games of the modified Blackjack type, i.e., pseudo-blackjack games, are also known to those having ordinary skill in the gaming art, such as "Catch-22", "California Catch-22", and "New Jack". Copies of literature relating to these games are supplied herewith.

"Catch-22", for example, shares many of the deficiencies of the Wisted game, principally differing therefrom in the ranking of the hands.

Another casino card game is shown and described in U.S. Pat. No. 4,659,087, hereinafter sometimes called "Shen", which was issued to Margaret Shen and Barry R. Forrester on Apr.21, 1987, and requires players to maintain two pairs of cards while playing.

The term "prior art" as used herein or in any statement made by or on behalf of applicant means only that any document or thing referred to as prior art bears, directly or inferentially, a date which is earlier than the effective filing date hereof.

An Information Disclosure Statement and copies of prior art are supplied to the United States Patent and Trademark office herewith.

SUMMARY OF THE INVENTION

Accordingly, it is an object of the present invention to provide pseudo-blackjack games which are more complex, more challenging and more exciting than the pseudo-blackjack games of the prior art.

Another object of the present invention is to provide pseudo-blackjack games which will be accepted by a wider audience than the pseudo-blackjack games of the prior art.

A further object of the present invention is to provide novel pseudo-blackjack games which are superior in their playability to the pseudo-blackjack games of the prior art.

Yet another object of the present invention is to provide pseudo-blackjack games in which the rank determination function (see Glossary) makes the game easier to learn, and thus more acceptable to both new and experienced players than pseudo-blackjack games of the prior art.

A further object of the present invention is to provide pseudo-blackjack games in which naturals occur more frequently than in the pseudo-blackjack games of the prior art, and which thus are more exciting than the pseudo-blackjack games of the prior art.

A yet further object of the present invention is to provide pseudo-blackjack games in which "doubling down" is permitted, and which are thus characterized by more variety, complexity and excitement than the pseudo-blackjack games of the prior art.

An additional object of the present invention is to provide pseudo-blackjack games in which ties are handled in such a manner as to permit the varying of the advantage between the ordinary players and the player-banker, whereby to provide more variety, complexity and excitement in the playing of the games of the invention than in the playing of such games of the prior art.

Another object of the present invention is to provide pseudo-blackjack games in which the splitting of pairs of initially dealt cards, e.g., two Kings, is permitted.

Other objects of the present invention will in part be obvious and will in part appear hereinafter.

The present invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of the present invention will be indicated in the claims appended hereto.

In accordance with a first principal feature of the present invention, four or less classes of participants may participate in the playing of certain embodiments thereof, viz.: one non-playing "dealer", also sometimes called the "house dealer"; one "player-banker"; (sometimes called "player-dealer") and at least one "ordinary player". The term "player" as used herein is generic, and denotes both player-bankers, player-dealers or ordinary players. However, where the distinction is clear from the context the term "player" is sometimes used as synonymous with the term "ordinary player". It is also to be understood that in certain other embodiments of the present invention the house dealer plays each round, and the other players play against the house dealer.

In accordance with a second principal feature of the present invention the deck or decks of cards utilized in playing the games of certain embodiments of the present invention each consist of a standard fifty-two card deck to each of which four jokers may be added, the point value of each joker being 2 or 12 at the receiving player's election.

In accordance with another principal feature of the present invention a novel hand ranking method is employed in which the combination of a face card and a joker, initially dealt, constitutes a natural.

In accordance with yet another principal feature of the present invention novel pseudo-blackjack games are provided in which "doubling down" is permitted.

In accordance with an additional principal feature of the present invention novel pseudo-blackjack games are provided in which the splitting of pairs of initially dealt cards is permitted.

In accordance with a further principal feature of the present invention, prior to the dealing of any cards in certain games of the invention the house has the option of handling ties in any one of the following ways: (1) the player-banker or the player-dealer wins ties on any hand or hands of a predetermined value or values, (2) players win ties on another hand or hands of a predetermined value or values, (3) the player-banker or player-dealer and ordinary players win ties on any hand or hands of a predetermined value or values, and (4) all ties are a push and no one wins.

In accordance with a yet further principal feature of the present invention the rank of each hand played in a card game of one of a certain class of preferred embodiments of the present invention, i.e., the second class or II(n) class, where "n" is any natural number, is determined in accordance with, i.e., is a function of, a plurality of hand parameters.

In accordance with another principal feature of the present invention games of the II(n) class thereof are played in accordance with the plural hand parameter principle of the present invention.

In accordance with yet another principal feature of the present invention, in the games of the third (or III(n) class) of preferred embodiments thereof the number of cards of a particular numerical (face) value in each playing deck may be more or less than four.

For a fuller understanding of the nature and objects of the present invention, reference should be had to the following detailed description, taken in connection with the accompanying drawings.

BRIEF DESCRIPTION OF THE DRAWINGS

FIG. 3 is a tabular representation of the rank determination function of the II(1) embodiment of the present invention; and FIG. 4 is a partial sequential representation of the rank determination function of the II(1) embodiment of the present invention.

DESCRIPTION OF THE PREFERRED EMBODIMENT

Figures 1, 2:
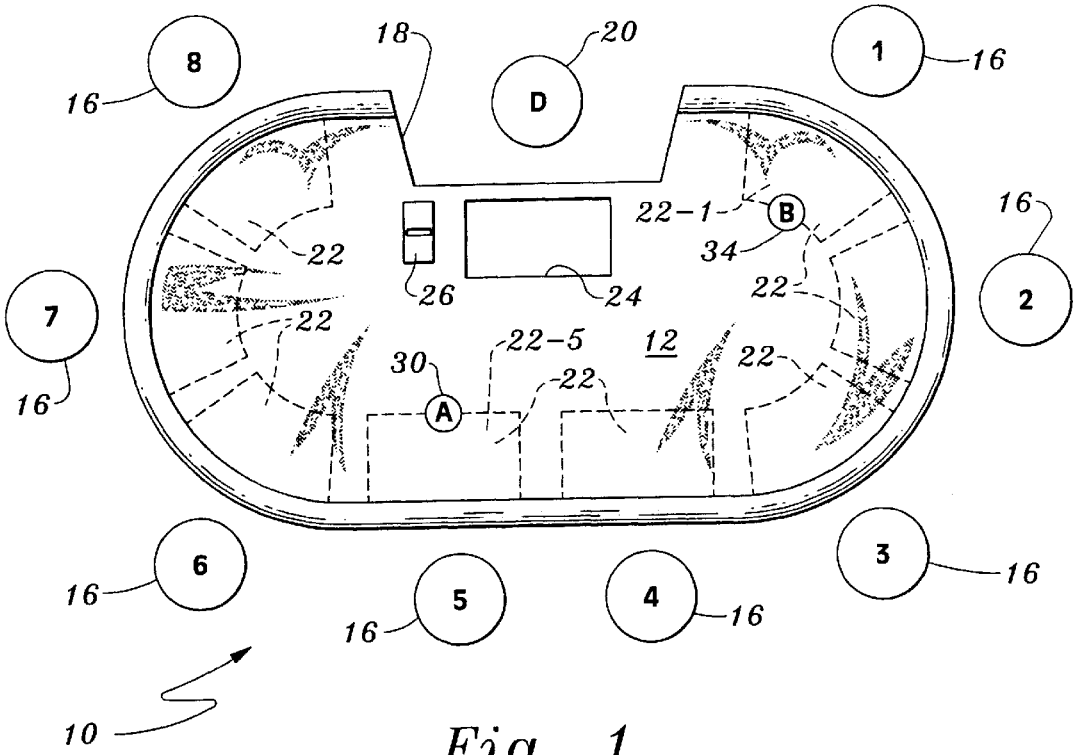
FIG. 1 is a plan view of a playing table upon which a card game of the present invention may be played.
FIG. 2 is the hand rankings chart of the first preferred embodiment of the present invention.

The card games of the present invention are characterized by certain preferred features, e.g. , playing method steps, which, collectively or individually, impart to the games of the present invention the desirable features thereof described hereinabove, such as easy playability by a class of players who would be deterred from playing one of the more complex pseudo-blackjack games of the prior art by the relatively high skill requirements thereof.

In accordance with one of said preferred features of the present invention the card value of each Joker is either 2 or 12.

In accordance with another one of such preferred features of certain embodiments of the present invention, sometimes called "California embodiments" or "California Games", three classes of participants participate in the playing of each round of a game of the present invention: one non-playing "dealer", also sometimes called the "house dealer"; one "player-banker" or "player-dealer"; and at least one "ordinary player". The term "player" as used herein is generic, and denotes both player-bankers and ordinary players. However, where the distinction is clear from the context the term "player" is sometimes used as synonymous with the term ordinary player".

In accordance with another such preferred feature of the present invention, the ranking of hand values in certain card games of the present invention (in descending value order) is 22, 21, 20, 19, 18, 17, 16, 15, 14, 13, 12, 11, 10, 9, 8, 7, 6, 5, 4, 3, 23, 24, 25, 26, 27, 28, 29, 30 and 31.

In accordance with yet another one of said preferred features of the present invention, in certain embodiments thereof a player whose hand count totals 22 after the first two cards are dealt to him or her, i.e., has a natural, and thus is paid a predetermined multiple, 1.5 or 2.0, of his bet by the banker.

In accordance with another one of said preferred features of the present invention any ordinary player may increase his or her bet after receiving his or her first two cards and contracting for one, and only one, additional card.

In accordance with another one of said preferred features of the present invention, any player in certain games of the present invention may split pairs of initially dealt cards into two separate hands.

The terms "wager" and "bet" have the same denotation herein.

In accordance with another one of said preferred features of the present invention, in certain embodiments thereof any player, including the player-banker, automatically loses on a particular hand (said to be a "busted hand") when the count of the cards dealt to him or her on that particular hand exceeds 22 (or some other predetermined number). In any given round, if the hand count of the cards dealt to an ordinary player and the player-banker both exceed 22, the player-banker wins.

The following preferred features may also be incorporated in certain embodiments of the present invention:

(a) Jokers may be added to the deck being played, in which case these Jokers count as 2 or 12;
(b) Aces can be left in the deck being played, in which case any such Ace counts as 1 or 11;
(c) Jokers may be substituted for Aces in the deck being played;
(d) The player-banker may decide, at his sole discretion, whether to ask for additional cards;
(e) The ordinary player who receives cards first in any particular round, called herein the "action player" for that round, is entitled to make the first election to draw a further card, to compare his or her cards with the hand of the player-banker, and to settle his or her wager with the player-banker;
(f) The dealing of cards, etc., is carried out by a dealer selected by the house;
(g) During the playing of each round one player is designated the player-banker, and another player is designated the fraction player";
(h) The designation of a player as the player-banker is made by means of a well known random selection device or devices, such as a deck of playing cards, and each player thus selected has the option of declining to serve as the player-banker;
(i) At the beginning of the playing of a round, one ordinary player is selected as the initial action player by suitable random selection means, e.g., dice;
(j) A highly visible token or marker which is marked or configured to identify the player-banker is provided, and is at all times located on the playing table at the playing position of the player then serving as the player-banker;
(k) A highly visible token or marker which is marked or configured to identify the action player is provided, and is at all times located on the playing table at the playing position of the player then serving as the action player;
(1) At the beginning of the playing of each round, starting with the current action player, the dealer deals one card at a time until every player has two cards, the player-banker's cards being dealt one face up and one face down;
(m) At the beginning of the playing of each round, before any cards are dealt, each participating player places his or her wager in the designated area of his or her playing station, in cash or chips;
(n) The hand rankings are as shown in FIG. 2;
(o) Prior to the dealing of any cards, the house, through the dealer, may elect any one of the following procedures for handling ties:
  (1) The player-banker wins ties on any hand or hands of a predetermined value or values;
  (2) Ordinary players win ties on any hand or hands of a predetermined value or values;
  (3) The player-banker and ordinary players win ties on any hand or hands of a predetermined value or values; and
  (4) All ties are a push and no-one wins.
(p) When the point values of the first two cards dealt to any ordinary player equals 22, that ordinary player is paid a predetermined multiple of his or her bet (e.g., 1.5 or 2.0 times his or her bet);
(q) Any ordinary player may increase his or her bet after that ordinary player receives his or her first two cards and contracts for a third and only additional card.
(r) The player-banker may ask the dealer for additional cards, or not do so, at his option; or, alternatively, the "player-banker's decisions are predetermined";
(s) The action player will receive his or her initially dealt pair of cards first, will have first election as to drawing additional cards, and will be first to compare his or her hand with the hand of the player-banker, and also will be first paid off on a winning bet, or be first to pay a losing bet;
(t) Each player (including the player-banker) loses, i.e. is "busted", when the sum of the values of his cards is greater than 22 or another preselected number;
(u) The house banks the game, the house dealer plays against all of the other players, and thus there is no player-banker;
(v) Certain games fall into one of two classes, viz., "player-banker games" in which there is a player-banker and "house-banked games" in which the house dealer plays;
(w) The player-banker position rotates among the players, giving each of the players an opportunity to serve as player-banker.

Referring now to FIG. 1, there is shown a card playing table 10 upon the playing surface 12 of which the card game of the I(1) embodiment of the present invention may be played.

In the well known manner, playing surface 12 of table 10 is surrounded by a raised edge portion 14 of the kind sometimes called a "rail".

As further seen in FIG. 1, table 10 is surrounded by eight stools 16, each stool being provided for one of the eight possible players of the card game of the I(1) embodiment of the present invention.

Table 10 is provided with a conventional inlet portion 18 wherein there is disposed a stool 20 provided for the use of the house dealer.

As indicated in dashed lines in FIG. 1, an area 22 of playing surface 12 is allocated to each player. These individually allocated areas of playing surface 12 are sometimes called "player stations".

Playing surface 12 is preferably faced with green felt whereon each player station 22 is subdivided into card-receiving areas, a wagering area, etc., by boundary lines imprinted in white to contrast with green playing surface 12.

Table 10 can also be provided with a dealer's receptacle 24 adapted to receive a dealer's tray (not shown), which a tray may contain chips and cards which can be used by the players.

Further, a cash lockbox 26 may be inset into playing surface 12, and a cover provided thereover which contains a slot 26.1 by means of which to insert paper currency into lockbox 26.

In the known manner, a plunger may be provided by means of which to push paper currency into lockbox 26 through said slot.

Further, two indicators or markers 30, 34 are placed upon playing surface 12, at the inner edges of two different player stations 22.

As seen in FIG. 1, indicator 30, which is marked "A", is located at the edge of player station 22-5, indicating that player No. 5 is the "action player"; and indicator 34, which is marked "B", is placed at the inner edge of player station 22-1, indicating that player No. 1 is the player-banker at the stage of play indicated in FIG. 1.

It is to be understood that many other forms of indicator 30, 34 may be used in the playing of the card games of the present invention.

Referring now to FIG. 2, there is shown a chart of the hand rankings used in playing the card game of the I(1) embodiment of the present invention.

The Playing of the Game of the First Preferred (1 (1)) Embodiment of the Present invention The preferred embodiments of the present invention fall into several classes, each of which classes is designated by a Roman numeral. Each embodiment or game in each such class is designated by an Arabic numeral. Thus, each particular embodiment or game of my present invention may be designated herein by the Roman numeral designating the class of preferred embodiments of which it is a member, followed by its membership number in that class in Arabic numerals contained in parentheses. When the members of a class are indicated collectively the Arabic numeral is replaced by an n. The parenthetical expression may sometimes be designated a particular subclass, e.g., N(n+1) designates all members of the class N but the first member. In every case n is a natural number.

The game of the first preferred embodiment (I(1)) of the present invention is played with a standard 52-card deck, to which four Jokers are added.

It is to be understood, however, that different decks may be employed in the games of other embodiments of the present invention.

In accordance with a principal feature of the I(1) embodiment of the present invention, Jokers count 2 or 12.

In the game of the I(1) embodiment of the present invention Aces count 1 or 11, all face cards count 10, and all other cards count the same number of points as their face value.

The Deck. It is also to be noted that the game of the I(1) embodiment of the present invention, and games of certain other embodiments of the present invention, may be played with more than one deck.

The Action. By a random method, e.g., the use of dice, the dealer, at the commencement of the playing of each round, determines which player receives cards first, acts first on his or her hand, and has his or her bet or bets settled first. This player, sometimes called the "action player", receives action player indicator 30 (FIG. 1), and places action player indicator 30 on the inner boundary of his or her player station, i.e., on the boundary of his or her player station nearest the center of table 10. The action rotates clockwise around the table, starting with the action player.

The Deal. The House dealer shuffles the one or more decks of cards to be used in playing the game of the first I(1) embodiment of the present invention, and the deck or decks are cut.

Cards are then dealt one-at-a-time to each player in turn (including the player-banker), beginning with the action player, at the inner edge of whose player station action player indicator 30 (FIG. 1) is located.

Two cards are dealt, one at a time, by the house dealer to each player, including the player-banker. The player-banker receives his or her first card face up, and his or her second card face down. No cards are dealt to the house dealer.

The Play of the Game of First Preferred (I(1)) Embodiment. The object of the game of the first preferred (I(1)) embodiment of the present invention is to get a higher ranking hand, as between any of the players and the player-banker.

In the play of the game of the I(1) embodiment of the present invention all ordinary players play against the player-banker, and the player-banker plays against each ordinary player.

In playing each round of the game of the I(1) embodiment, after the first two cards are dealt, if the player-banker is showing a Joker, an Ace, a face card or a 10, the house dealer or the player-banker checks the face down card. If the sum of the point values of the player-banker's two cards is 22, the player-banker is said to have been dealt a "two card 22". The house dealer immediately turns this "two card 22" hand over, and any of the ordinary players who do not also have a two card 22 lose, except when the player-banker's wager is deficient, as discussed below.

In the card game of the I(1) embodiment of the present invention the highest ranking two card 22 hand consists of two Aces (see FIG. 2).

If both of the two cards dealt to an ordinary player or a player-banker are Aces, that ordinary player or player-banker is holding the highest ranking hand possible in a game of the I(1) embodiment of the present invention (see FIG. 2).

In any game of the I(1) embodiment of the present invention bets are settled starting with the action player and rotating clockwise around the table until all of the money in the bank, i.e. , all of the money put up by the player-banker, has had action, or all of the players' bets have had action.

Each other player who has been dealt a two card 22 in the same round in which the player-banker is dealt a two card 22 pushes (or is tied) with the player-banker, provided always that a pair of Aces (AA) beats any other two card 22.

Any ordinary player who has been dealt a two card 22 when, at the same time, the player-banker has not been dealt a two card 22, cannot be beaten or tied.

If, after the first two cards have been dealt to each player, it is determined that a two card 22 has not been dealt to the player-banker, the dealer inquires whether the action player desires any additional cards.

The action player may continue to ask for cards as long as the total point value of all of his or her cards does not exceed 22.

If the point value of the action player's cards exceeds 22, the action player must stop drawing cards.

However, the action player may stop drawing cards at any time prior to the time when the point value of his or her cards exceeds 22.

Once the point value of the action player's hand, i.e., all of the cards in his or her possession, has exceeded 22, or the action player has told the house dealer that he or she does not want any more cards, the next ordinary player to the left of the action player is permitted to draw cards.

This procedure continues in the clockwise direction around table 10 until all of the other players participating in the current round have had one opportunity to draw cards, and the point values of their respective hands have either exceeded 22 or they have refused additional cards.

At this time the player-banker is eligible for cards. The player-banker must draw cards to any hand that totals 17 or less.

The player-banker must stand on any hand which totals 18 or more, except that, at the option of the house, the player-banker must draw cards to any hand that totals 18, counting a Joker as 12 or an Ace as 11.

Pay-offs. Once the player-banker has stopped drawing cards, the dealer (using the player-banker's bet) will then settle the ordinary players' bets against the player-banker, paying off the ordinary players whose hands rank higher than the player-banker's hand, and collecting from the ordinary players whose hands rank lower than the player-banker's hand.

Ties. Prior to the dealing of any cards, the house, through the dealer, may elect any one of the following procedures for handling ties:

(a) The player-banker wins ties on any hand or hands of a predetermined value or values;

(b) ordinary players win ties on any hand or hands of a predetermined value or values;

(c) The player-banker and ordinary players win ties on any hand or hands of a predetermined value or values; and (d) All ties are a push and no-one wins.

Bets will then be settled starting with the action player and continuing in a clockwise direction around the table until all of the player-banker's bet has had action or all of the players' bets have had action.

Money wagered by the player-banker can only be used once to settle bets, win or lose.

If the player-banker runs out of money before all bets are settled, the subsequent bets receive no action, i.e., are unpaid or uncollected.

In other embodiments of the present invention the playing deck comprises four Aces and four Jokers, the point value of each Ace being 2 or 12, and the point value of each Joker being 1 or 11.

In yet other embodiments the playing deck includes no Jokers, and the four Aces thereof have each a point value of 2 or 12.

The Second Class (II) of Preferred Embodiments

The card games of the present invention which are described hereinabove are card games of the first class (I) of preferred embodiments of the present invention (sometimes called "games of the first class" hereinafter).

The card games described hereinafter are card games of the second class (II) and the third class (III) of preferred embodiments of the present invention (sometimes called "games of the second class" and "games of the third class" hereinafter).

The card games of the second class differ principally from the card games of the first class in that the rank of each hand played in a card game of the second class and thus the outcome of the game is set by a predetermined rule, i.e. is determined in accordance with a plurality of hand parameters.

For this reason, games of the second class are sometimes called "plural hand parameter games" herein; and are sometimes said to incorporate the "plural hand parameter principle" of my present invention.

The term "hand parameter", as used herein, denotes a predefined property or characteristic of each one of the totality of hands which can occur during the playing of a particular card game of my present invention, which property or characteristic differs for different ones of said hands.

The point count value of a particular hand, i.e. the total sum of the point values for all the cards in that hand, is one such hand parameter during the playing of a typical prior art casino card game. Most typical prior art casino card games consider only that particular hand parameter when ranking the hands.

In accordance with the plural hand parameter principle, which is a principal feature of my present invention, the rank of a particular hand occurring during a particular game is not determined in accordance with but one hand parameter as in most prior art casino card games, but rather is determined in accordance with a plurality of hand parameters.

Thus, for example, in the card game of the first preferred embodiment of the second class of embodiments of my present invention (sometimes called the "II(1) game" or "II(1) embodiment") the rank of any particular actually occurring hand is determined by two hand parameters, viz., the point count value (v) of that hand, and the membership category (m) of the player of that particular hand.

The term "membership category", as used herein with reference to a particular player of a particular card game of the second class of preferred embodiments of the present invention denotes the membership or non-membership of that player in one or more predefined subsets of the totality of possible players in that particular card game.

The term "membership category" is sometimes denoted by the letter "m" herein.

In the II(1) embodiment of the present invention one membership category is the A category, which includes all of the players, including the player-banker. Also in the II(1) embodiment of the present invention, another membership category is the B category, which includes only the current player-banker. A yet further membership category of the II(1) embodiment of the present invention is the P category, which includes only the ordinary players.

Thus, it will be seen that in the II(1) card game of the present invention every player is a member of one or more of these membership categories.

Other membership categories will occur to those having ordinary skill in the casino gaming art, informed by the present disclosure, without the exercise of invention and without undue deliberation.

As will now be evident to those having ordinary skill in the casino gaming art, informed by the present disclosure, my plural hand parameter principle, which is a principal feature of my present invention, may be applied to many card games of the prior art, and particularly to games of the first class of preferred embodiments of my present invention, resulting in new casino card games having new properties and highly desirable features not found in casino card games of the prior art.

As will also be apparent to those having ordinary skill in the casino gaming art, informed by the present disclosure, any particular card game of the second class of preferred embodiments of my present invention may be partially defined by its rank determination function; the term "rank determination function" being a predetermined rule denoting the relationship between the rank of any hand which can occur during the playing of that particular card game and a plurality of hand parameters and which determines the outcome of the game.

It will also be evident to those having ordinary skill in the casino gaming art, informed by the present disclosure, that any such rank determination function may be completely represented or defined in matrix (tabular) form or in sequence form.

Such a matrix or tabular form is comparable to the well known hand ranking charts of the prior art, and thus may sometimes be called a "hand ranking chart" herein.

A hand ranking chart or matrix (tabular) representation of the rank determination function of game II(1) of the present invention is shown in FIG. 3.

A partial sequence which is the equivalent of part of the rank determination function representing matrix of FIG. 3 is shown in FIG. 4.

Referring now to FIG. 3, it will be seen that the hand ranking chart of the II(1) game of the present invention is comprised of three columns, viz., the rank or hand rank column (r), the point count value column (v) and the membership category column (m).

It is to be particularly noted that in the well known manner each ellipsis, " . . . ", indicates either a sequence of natural numbers which have been deleted from the tabulation for clarity of presentation (columns r and v), or repetitions of the same alphabetical letter found above and below the ellipsis (column M).

Thus, in column (r), the uppermost ellipsis takes the place of the vertical array of natural numbers 4, 5 and 6. In column (v) the uppermost ellipsis takes the place of the vertical array of natural numbers 21, 20 and 19. In column (m) the uppermost ellipsis takes the place of the vertical array of three repetitions of the same letter, A, A, A. Similarly, in column (r) of FIG. 3 the vertical array 3, . . . , 7 represents the full vertical array 3, 4, 5, 6, 7; in column (v) the vertical array 22, . . . , 18 represents the full vertical array 22, 21, 20, 19, 18; and in column (m) the uppermost vertical array A, . . . , A represents the full vertical array A, A, A, A, A.

It has been found by extensive public playing of the II(1) game in a casino located in California, that experienced casino personnel have no difficulty remembering the information tabulated in FIG. 3, nor in conducting the play of game II(1) as it is shown and described herein, and that the II(1) game has broad appeal among card players because of its rapid action and high excitement.

The equivalence between the partial sequence of FIG. 4 and the corresponding part of the hand ranking chart of FIG. 3 will be obvious to those having ordinary skill in the casino gaming art by simple direct comparison.

The Playing of the II(1) Casino Card Game of the Present Invention

The terms "casino card game", "card game" and "game" as used herein all denote a particular activity undertaken or regarded as a contest involving the use of playing cards and the placing of wagers by a plurality of participants (sometimes called "players"), and conducted in accordance with a predefined code of procedure, or protocol.

The term "particular game" as used herein denotes the particular code of procedure or protocol which defines and regulates a single, unique card game. Thus, the II(1) embodiment of my invention, which is defined herein by a particular hand rank determination function, discussed hereinabove, and a particular set of rules of play, discussed hereinbelow, constitutes a particular card game as that term is used herein.

The rules of play of the II(1) game may be described as follows.

Player-Banker Selection. In the II(1) game of the present invention, before any cards are dealt, one person is selected as the player-banker.

If a player does not wish to be player-banker, the option to be player-banker passes in turn to the next player to the left of the declining player. The position of the player-banker option rotates clockwise around the table (see FIG. 1 and the text of the present specification related thereto) so that all players have an opportunity to be the player-banker. A representative of the house deals at all times. The house dealer does not receive any cards, and does not participate as an ordinary player or as player-banker.

Cards. The II(1) game is played with a deck or decks of fifty-three or more cards, including one or more Jokers. Aces can be played as one or eleven, Jokers as two or twelve. All face cards count as ten. All other cards count as their face value. The suit designations of the individual cards are without significance, and are ignored.

Betting. In the II(1) game the individual players bet against the player-banker, and the player-banker bets against each individual player.

After receiving their first two cards and contracting for a third and only additional card, at the option of the house, players may make an additional bet or wager.

The Action. By a random method (e.g., the casting of dice by the player-banker) the house dealer determines which player, i.e., which player position has its bet or bets settled first. This player position receives the action button or other indicator. The action rotates clockwise around the table, starting with the player position at which the action button is initially located.

The Deal. The house dealer shuffles, and the deck or decks are cut. Cards are then dealt, one at a time in turn to each player. (Cards may be dealt face-up or face-down, at the option of the house.) Each player initially receives two cards. The player-banker receives one card face up and one card face down. The house dealer does not receive any cards.

The Play. The object of the II(1) game is to get the highest ranking hand. All players play against the player-banker and the player-banker plays against each individual player.

After the initial two cards are dealt, if the player-banker is showing a Joker, an Ace, a face card, or a ten, the house dealer or player-banker checks the face-down card. If the sum of the player-banker's two cards gives him or her a total of 22, then he or she has a two-card 22. When this occurs the house dealer immediately turns the hand over and any players who do not also have a two-card 22 lose. The highest ranking two-card 22 is two Aces. If both of a player or a player-banker's first two cards are Aces, he or she has the highest ranking hand possible in the II(1) game.

If the player-banker does not have a two-card 22, the house dealer will ask the first player if he or she wants any additional cards. That player may continue to draw cards as long as the total value of all of his or her cards does not equal or exceed 18. If the player's hand equals or exceeds 18, the player must stop drawing cards. Further, the player may elect to stop drawing cards at any time. Once the first player's hand has either equaled or exceeded 18, or the player has told the House dealer that he or she does not want any more cards, the next player to the left has the right to draw cards. This continues clockwise until all players have had the opportunity to draw cards, and their hands have either equaled or exceeded 18, or they have refused additional cards. At this time the player-banker is eligible for cards. The player-banker may continue to draw cards as long as the total of all of the player-banker's cards does not equal or exceed 18. The player-banker must stand on any hand which equals or exceeds 18, except that, at the option of the house, the player-banker must draw cards to any hand that total 18, counting a Joker as twelve or an Ace as eleven.

Hand Rankings. In the II(1) game of the present invention the rank of each hand is determined in accordance with the embodiment II(1) hand rank determination function represented by FIG. 3 and discussed in detail hereinabove in connection with FIG. 3.

Pay-offs. Once the player-banker has stopped drawing cards, the house dealer (using the player-banker's wager) will then settle the player's bets against the player-banker, paying off players whose hands rank higher than the player-banker's hand, and collecting from players whose hands rank lower than the player-banker's hand.

Ties. Prior to the dealing of any cards, the house selects one of the following modes of handling ties.

Mode 1. The player-banker wins ties on any hand or hands of a predetermined value or values.

Mode 2. Players win ties on any hand or hands of a predetermined value or values.

Mode 3. The player-banker and players win ties on any hand or hands of a predetermined value or values.

Mode 4. All ties are a push and no one wins.

In embodiment II(2) the player-banker of embodiment II(1) may be replaced by a house banker, or any other unvarying banker and the use of the action button may be eliminated.

The Third Class (III) of Preferred Embodiments

In accordance with a third class of embodiments of the present III(x) invention the playing deck or decks employed therein differ in composition from the playing decks of the other classes of embodiments of the present invention in accordance with the playing deck composition principle of my present invention which is described hereinbelow:

In accordance with my new playing deck composition principle, which is a principal feature of my present invention, the number of cards of a particular numerical value in the playing deck may be more or less than four.

Thus, by way of example only, the playing deck in a particular III(x) card game may include two 7-cards, two 2-cards, six 5-cards, and six 4-cards.

Further, by way of example only, the playing deck in a particular III(x) card game of the present invention may consist of the following fifty-six cards:

Four Jokers
Four Aces
Two Deuces
Four Threes
Six Fours
Six Fives
Four Sixes
Two Sevens
Four Eights
Four Nines
Four Tens
Four Jacks
Four Queens
Four Kings The number (quantity) of cards of each numerical card value in a particular new and novel playing deck of the III(x) embodiment of the present invention is so determined as to (1) provide a game of a particular new and novel mathematical structure, (2) give a particular class of player, e.g., the player-banker, a statistically predetermined numerical advantage in the continued playing of the particular game, or (3) suit the requirements of the house (casino) or a particular player population.

This new principle of playing deck composition, which is a principal feature of the present embodiment, will sometimes be called "card weighting".

It is to be understood that, in accordance with the III(1) class of embodiments, this new principle may be used to provide variant versions of any of the card games of the present invention described hereinabove.

Glossary

The term "pseudo-blackjack" as used herein denotes a casino card game which has a substantial number of properties or characteristics in common with the well known game of blackjack but also has some properties or characteristics which are not properties or characteristics of the well known game of blackjack.

The term "legal pseudo-blackjack" as used herein denotes a pseudo-blackjack game which is legally playable in a casino located in a jurisdiction the laws or regulations of which forbid the playing of the well known game of blackjack in a casino located therein.

The term "face-up game" as used herein denotes a card game in which all or most of the cards dealt are dealt face-up.

The term "actual hand" as used herein denotes a hand of cards which are dealt or drawn during the playing of an actual card game.

The term "standing hand" as used herein denotes a hand of cards on which a player or other participant, e.g., dealer, stands during the playing of an actual card game.

The term "possible hand" as used herein denotes a hand of cards which can occur during the playing of a particular card game.

The term "held" as used herein with reference to a card or cards in a particular card game is not limited in its denotation to a card or cards held in the hands of a player or other participant, but also denotes a card or cards dealt to or otherwise placed before a player or other participant in that card game.

The terms "casino card game", "card game", and "game" as used herein all denote an activity undertaken or regarded as a contest involving the use of playing cards and the placing of wagers by a plurality of participants (sometimes called "players"), and conducted according to a predefined code of procedure or protocol.

The term "particular game" as used herein denotes a particular code of procedure or protocol which defines and regulates a particular card game. Thus, one embodiment of my present invention constitutes a particular card game.

The terms "individual game" and "single game" as used herein denote a single round, cycle of activity, or contest executed under a particular card game protocol.

The term "rank determination function" as used herein with reference to a particular card game denotes the relationship between the rank of any hand which can occur during the playing of that particular card game and one or more hand parameters which uniquely identify that hand.

The term "hand parameter" as used herein denotes a predefinable property or characteristic of one or more of the totality of hands which can occur during the playing of a particular card game. In the first preferred embodiment of the second class of card games of the present invention, or II(1) game, e.g., the hand parameters are (1) the point count value (v) of each particular hand which occurs during the playing of that particular game, and (2) the membership category (m) of the player of that particular hand.

The term "membership category" as used herein with reference to a particular player of or participant in a particular embodiment or game of the present invention denotes the membership or non-membership of that player or participant in one or more predefined subsets of the totality of possible players of or participants in that particular embodiment or game of the present invention. The term "membership category" is sometimes denotes herein by the letter "m".

The term "player" as used herein is generic, and denotes both player-bankers and ordinary players. However, where the distinction is clear from the context the term "player" is sometimes used as synonymous with the term "ordinary player".

The terms "wager" and "bet" have the same denotation herein.

It will thus be seen that the objects set forth above, among those made apparent from the preceding description, are efficiently attained, and since certain changes may be made in the above constructions and the methods carried out thereby without departing from the scope of the present invention, it is intended that all matter contained in the above description or shown in the accompanying drawings shall be interpreted as illustrative only, and not in a limiting sense.

In accordance with the present invention certain embodiments thereof may include pair-splitting, doubling-down, or paying some multiple of a player's bet for a natural, or any combination of these.

It is also to be understood that the following claims are intended to cover all of the generic and specific features of the invention hereindescribed, and all statements of the scope of the invention which, as a matter of language, might be said to fall therebetween.

What is claimed is:

1. A method of playing, by a plurality of persons, a card game comprising the steps of:

naming one of said persons as the banker and the remaining persons as ordinary players;

assigning a point value to each card in a playing deck comprising a predetermined combination of playing cards chosen from one or more conventional decks of playing cards, with at least one Joker added;

assigning a predetermined point count value which the persons must attempt to achieve;

dealing two cards to each of said persons who places a bet at the commencement of a particular round from said playing deck;

dealing an additional card or cards from said playing deck to each one of said persons who requests the additional card or cards after the dealing of two cards to each one of said persons;

electing by each player who has been dealt a Joker the value of that Joker as only a two or only a twelve;

adding the point values of the cards in each said person's hand to give a point count value for each said person; and ranking each of the hands then held by one of said persons to determine an outcome in accordance with a predetermined rule, wherein said predetermined rule determines the outcome based on the total point value of the cards held by said person, and said person's status as the banker or as an ordinary player.

2. A method of playing a card game as claimed in claim 1 wherein the playing deck comprises a conventional deck of 52 cards with one or more Jokers added.

3. A method of playing a card game as claimed in claim 1 wherein the additional cards are dealt in turn first to the ordinary players and then to the banker.

4. A method according to claim 1 wherein the predetermined rule ranks the hands from best down to worst as et forth fully below.

| Rank | Hand | Player Status |
|---|---|---|
| 1st. | AA | Player-Banker or Ordinary Player |
| 2nd. | 22 Joker + (10 or face card) | Player-Banker or Ordinary Player |
| 3rd. | 22 | Player-Banker or Ordinary Player |
| 4th. | 21 | Player-Banker or Ordinary Player |
| 5th. | 20 | Player-Banker or Ordinary Player |
| 6th. | 19 | Player-Banker or Ordinary Player |
| 7th. | 18 | Player-Banker or Ordinary Player |
| 8th. | 17 | Ordinary Player |
| 9th. | 16 | Ordinary Player |
| 10th. | 15 | Ordinary Player |
| 11th. | 14 | Ordinary Player |
| 12th. | 13 | Ordinary Player |
| 13th. | 23 | Player-Banker or Ordinary Player |
| 14th. | 24 | Player-Banker or Ordinary Player |
| 15th. | 25 | Player-Banker or Ordinary Player |
| 16th. | 26 | Player-Banker or Ordinary Player |

-continued

| Rank | Hand | Player Status |
|---|---|---|
| 17th. | 27 | Player-Banker or Ordinary Player |
| 18th. | 17 | Player-Banker |
| 19th. | 16 | Player-Banker |
| 20th. | 15 | Player-Banker |
| 21st. | 14 | Player-Banker |
| 22nd. | 13 | Player-Banker |
| 23–31st. | 12–4 | Player-Banker or Ordinary Player |

5. A method of playing a card game as claimed in claim 1, further comprising the steps of electing by each player to double down or not double down.

6. A method of playing a card game as claimed in claim 1, further comprising the steps of:

handling ties in accordance with a house elected one of the following procedures:

(a) said banker wins all ties on any hand or hands of a predetermined value or values;

(b) the players win ties on any hand or hands of a predetermined value or values;

(c) said banker and the players win ties on any hand or hands of a predetermined value or values; or (d) all ties are a push and no one wins on a tie.

7. A method of playing, by a plurality of persons, a card game comprising the steps of:

naming one of said persons as the banker and the remaining persons as ordinary players;

assigning a point value to each card in a playing deck comprising a predetermined combination of playing cards chosen from one or more conventional decks of playing cards, with at least one Joker added;

assigning a predetermined point count value which the persons must attempt to achieve;

dealing two cards to each of said persons who places a bet at the commencement of a particular round from said playing deck;

dealing an additional card or cards from said playing deck to each one of said persons who requests the additional card or cards after the dealing of two cards to each one of said persons;

adding the point values of the cards in each said person's hand to give a point count value for each said person; and ranking each of the hands then held by one of said persons to determine an outcome in accordance with an order from best down to worst as follows:

| Rank | Hand | Player Status |
|---|---|---|
| 1st. | AA | Player-Banker or Ordinary Player |
| 2nd. | 22 Joker + (10 or face card) | Player-Banker or Ordinary Player |
| 3rd. | 22 | Player-Banker or Ordinary Player |
| 4th. | 21 | Player-Banker or Ordinary Player |
| 5th. | 20 | Player-Banker or Ordinary Player |
| 6th. | 19 | Player-Banker or Ordinary Player |
| 7th. | 18 | Player-Banker or Ordinary Player |
| 8th. | 17 | Ordinary Player |
| 9th. | 16 | Ordinary Player |
| 10th. | 15 | Ordinary Player |
| 11th. | 14 | Ordinary Player |
| 12th. | 13 | Ordinary Player |
| 13th. | 23 | Player-Banker or Ordinary Player |
| 14th. | 24 | Player-Banker or Ordinary Player |
| 15th. | 25 | Player-Banker or Ordinary Player |

-continued

| Rank | Hand | Player Status |
|---|---|---|
| 16th. | 26 | Player-Banker or Ordinary Player |
| 17th. | 27 | Player-Banker or Ordinary Player |
| 18th. | 17 | Player-Banker |
| 19th. | 16 | Player-Banker |
| 20th. | 15 | Player-Banker |
| 21st. | 14 | Player-Banker |
| 22nd. | 13 | Player-Banker |
| 23–31st. | 12–4 | Player-Banker or Ordinary Player. |

8. A method of playing a card game as claimed in claim 7 wherein the playing deck comprises a conventional deck of 52 cards with one or more Jokers added.

9. A method of playing a card game as claimed in claim 7, further comprising the step or steps of electing by each player who has been dealt a Joker the value of that Joker as two or twelve.

10. A method of playing a card game as claimed in claim 7 wherein the additional cards are dealt in turn first to the ordinary players and then to the banker.

11. A method of playing a card game as claimed in claim 7, further comprising the steps of electing by each player to double down or not double down.

12. A method of playing a card game as claimed in claim 7, further comprising the steps of:

handling ties in accordance with a house elected one of the following procedures:

(a) said banker wins all ties on any hand or hands of a predetermined value or values;

(b) the players win ties on any hand or hands of a predetermined value or values;

(c) said banker and the players win ties on any hand or hands of a predetermined value or values; or (d) all ties are a push and no one wins on a tie.

13. A method of playing, by a plurality of persons, a card game comprising the steps of:

naming one of said persons as the banker and the remaining persons as ordinary players;

assigning a point value to each card in a playing deck comprising a predetermined combination of playing cards chosen from one or more conventional decks, of playing cards, with at least one Joker added;

assigning a predetermined point count value which the persons must attempt to achieve;

dealing two cards to each of said persons who places a bet at the commencement of a particular round from said playing deck;

dealing an additional card or cards from said playing deck to each one of said persons who requests the additional card or cards after the dealing of two cards to each one of said persons;

adding the point values of the cards in each said person's hand to give a point count value for each said person;

ranking each of the hands then held by one of said persons to determine an outcome in accordance with a predetermined rule, wherein said predetermined rule determines the outcome based on the total point value of the cards held by said person, and said person's status as the banker or as an ordinary player; and handling ties in accordance with a house-elected one of the following procedures:

(a) said banker wins all ties on any hand or hands of a predetermined value or values;

(b) the players win ties on any hand or hands of a predetermined value or values;

(c) said banker and the players win ties on any hand or hands of a predetermined value or values; or (d) all ties are a push and no one wins on a tie.

14. A method of playing, by a plurality of persons, a card game comprising the steps of:

naming one of said persons as the banker and the remaining persons as ordinary players;

assigning a point value to each card in a playing deck comprising a predetermined combination of playing cards chosen from one or more conventional decks of playing cards, with at least one Joker added;

assigning a predetermined point count value which the persons must attempt to achieve;

dealing two cards to each of said persons who places a bet at the commencement of a particular round from said playing deck;

dealing an additional card or cards from said playing deck to each one of said persons who requests the additional card or cards after the dealing of two cards to each one of said persons;

adding the point values of the cards in each said person's hand to give a point count value for each said person; and ranking each of the hands then held by one of said persons to determine an outcome in accordance with a predetermined rule, wherein said predetermined rule determines the outcome based on the total point value of the cards held by said person, and said person's status as the banker or as an ordinary player, wherein the following pairs of cards are natural: a pair of Aces, a Joker and a ten, and a Joker and any face card.

15. A method of playing a card game as claimed in claim 14 in which the hands of cards dealt to the persons are ranked in accordance with the hand ranking chart of the present invention as follows:

| HIGHEST | LOWEST |
|---|---|
| FIRST | AA (NATURAL) |
| THEN | TWO CARD 22 (NATURAL) |
| NEXT | 22 21 20 19 18 17 16 15 14 13 12 |
| LAST | 23 24 25 26 27 28 29 30 31. |

16. A method of playing, by a plurality of persons, a card game comprising the steps of:

naming one of said persons as the banker and the remaining persons as ordinary players;

assigning a point value to each card in a playing deck comprising one or more conventional decks of 52 playing cards, with at least one Joker added;

assigning a predetermined point count value which the persons must attempt to achieve;

dealing two cards to each of said persons who places a bet at the commencement of a particular round from said playing deck;

dealing an additional card or cards from said playing deck to each one of said persons who requests the additional card or cards after the dealing of two cards to each one of said persons;

electing by each player who has been dealt a Joker the value of that Joker as two or twelve;

adding the point values of the cards in each said person's hand to give a point count value for each said person; and ranking each of the hands then held by one of said persons to determine an outcome in accordance with an order from best down to worst as follows:

| Rank | Hand | Player Status |
|---|---|---|
| 1st. | AA | Player-Banker or Ordinary Player |
| 2nd. | 22 Joker + (10 or face card) | Player-Banker or Ordinary Player |
| 3rd. | 22 | Player-Banker or Ordinary Player |
| 4th. | 21 | Player-Banker or Ordinary Player |
| 5th. | 20 | Player-Banker or Ordinary Player |
| 6th. | 19 | Player-Banker or Ordinary Player |
| 7th. | 18 | Player-Banker or Ordinary Player |
| 8th. | 17 | Ordinary Player |
| 9th. | 16 | Ordinary Player |
| 10th. | 15 | Ordinary Player |
| 11th. | 14 | Ordinary Player |
| 12th. | 13 | Ordinary Player |
| 13th. | 23 | Player-Banker or Ordinary Player |
| 14th. | 24 | Player-Banker or Ordinary Player |
| 15th. | 25 | Player-Banker or Ordinary Player |
| 16th. | 26 | Player-Banker or Ordinary Player |
| 17th. | 27 | Player-Banker or Ordinary Player |
| 18th. | 17 | Player-Banker |
| 19th. | 16 | Player-Banker |
| 20th. | 15 | Player-Banker |
| 21st. | 14 | Player-Banker |
| 22nd. | 13 | Player-Banker |
| 23–31st. | 12–4 | Player-Banker or Ordinary Player. |

17. A method of playing, by a plurality of persons, a card game comprising the steps of:

naming one of said persons as the banker and the remaining persons as ordinary players;

assigning a point value to each card in a playing deck comprising one or more conventional decks of 52 playing cards, with at least one Joker added; assigning a predetermined point count value which the persons must attempt to achieve;

dealing two cards to each of said persons who places a bet at the commencement of a particular round from said playing deck;

dealing an additional card or cards from said playing deck to each one of said persons who requests the additional card or cards after the dealing of two cards to each one of said persons;

electing by each player who has been dealt a Joker the value of that Joker as two or twelve;

adding the point values of the cards in each said person's hand to give a point count value for each said person; and ranking each of the hands then held by one of said persons to determine an outcome in accordance with a predetermined rule, wherein said predetermined rule determines the outcome based on the total point value of the cards held by said person, and said person's status as the banker or as an ordinary player, wherein the following pairs of cards are natural: a pair of Aces, a Joker and a ten, and a Joker and any face card.

18. A method of playing a card game as claimed in claim 17 in which the hands of cards dealt to the persons are ranked in accordance with the hand ranking chart of the present invention as follows:

| HIGHEST | LOWEST |
|---|---|
| FIRST | AA (NATURAL) |
| THEN | TWO CARD 22 (NATURAL) |
| NEXT | 22 21 20 19 18 17 16 15 14 13 12 |
| LAST | 23 24 25 26 27 28 29 30 31. |

19. A method of playing a card game as claimed in claim 18 in which doubling down is permitted.

20. A method of playing a card game as claimed in claim 17, further comprising the steps of:

handling ties in accordance with a house elected one of the following procedures:

(a) said banker wins all ties on any hand or hands of a predetermined value or values;

(b) the players win ties on any hand or hands of a predetermined value or values;

(c) said banker and the players win ties on any hand or hands of a predetermined value or values; or (d) all ties are a push and no one wins on a tie.

21. A method of playing, by a plurality of persons, a card game comprising the steps of:

naming one of said persons as the banker and the remaining persons as ordinary players;

assigning a point value to each card in a playing deck comprising one or more conventional decks of 52 playing cards, with at least one Joker added;

assigning a predetermined point count value which the persons must attempt to achieve;

dealing two cards to each of said persons who places a bet at the commencement of a particular round from said playing deck;

dealing an additional card or cards from said playing deck to each one of said persons who requests the additional card or cards after the dealing of two cards to each one of said persons;

electing by each player who has been dealt a Joker the value of that Joker as two or twelve;

adding the point values of the cards in each said person's hand to give a point count value for each said person; and ranking each of the hands then held by one of said persons to determine an outcome in accordance with a predetermined rule, wherein said predetermined rule determines the outcome based on the total point value of the cards held by said person, and said person's status as the banker or as an ordinary player, and handling ties in accordance with a house elected one of the following procedures:

(a) said banker wins all ties on any hand or hands of a predetermined value or values;

(b) the players win ties on any hand or hands of a predetermined value or values;

(c) said banker and the players win ties on any hand or hands of a predetermined value or values; or (d) all ties are a push and no one wins on a tie.

* * * * *